United States Patent [19]

Gagnon et al.

[11] Patent Number: 4,875,660

[45] Date of Patent: Oct. 24, 1989

[54] PUSH ACTUATOR

[76] Inventors: Pierre Gagnon, 5637 Wilderton Avenue, Montreal, Canada, H3T 1S1; Pierre Laforest, 1945 de Bruxelles Street, Montreal, Canada, H1L 5Z5

[21] Appl. No.: 306,410

[22] Filed: Feb. 6, 1989

Related U.S. Application Data

[63] Continuation-in-part of Ser. No. 151,650, Feb. 2, 1988, abandoned.

[51] Int. Cl.[4] ..... B66F 3/08

[52] U.S. Cl. ..... 254/1; 254/89 R; 254/98

[58] Field of Search ..... 254/1, 98, 89 R, DIG. 6; 74/501 R; 52/10, 108

[56] References Cited

U.S. PATENT DOCUMENTS 1,570,429 1/1926 Bonnet ..... 254/1
2,173,685 9/1939 Grassmann ..... 254/1
2,265,892 9/1941 Bloch .
2,946,556 7/1960 Edgerton .

FOREIGN PATENT DOCUMENTS 391718 8/1940 Canada .
1331910 5/1972 United Kingdom ..... 254/1

*Primary Examiner*—Robert C. Watson

[57] ABSTRACT

This telescopic tube is formed of a first and of a second continuous bands wound in a spiral and in a helix, respectively, with the turns of each band lying flat against each other in the retracted position of the tube. The turns of the respective bands are normal to one another. To extend the tube, the turns of the first band are spaced from each other, and the turns of the second band are inserted between the spaced turns of the first band, so as to act as spacers for the latter turns. A mechanism is described to cause extension and retraction of the tube which is mainly used as a push actuator.

17 Claims, 6 Drawing Sheets

14
48
50
32
36
34
62
52B
4
10
52
42
36
38
44
40
46
60
52
52A
4
32
22
24
28
26
20
16
18
6
40
44
28

Fig. 7
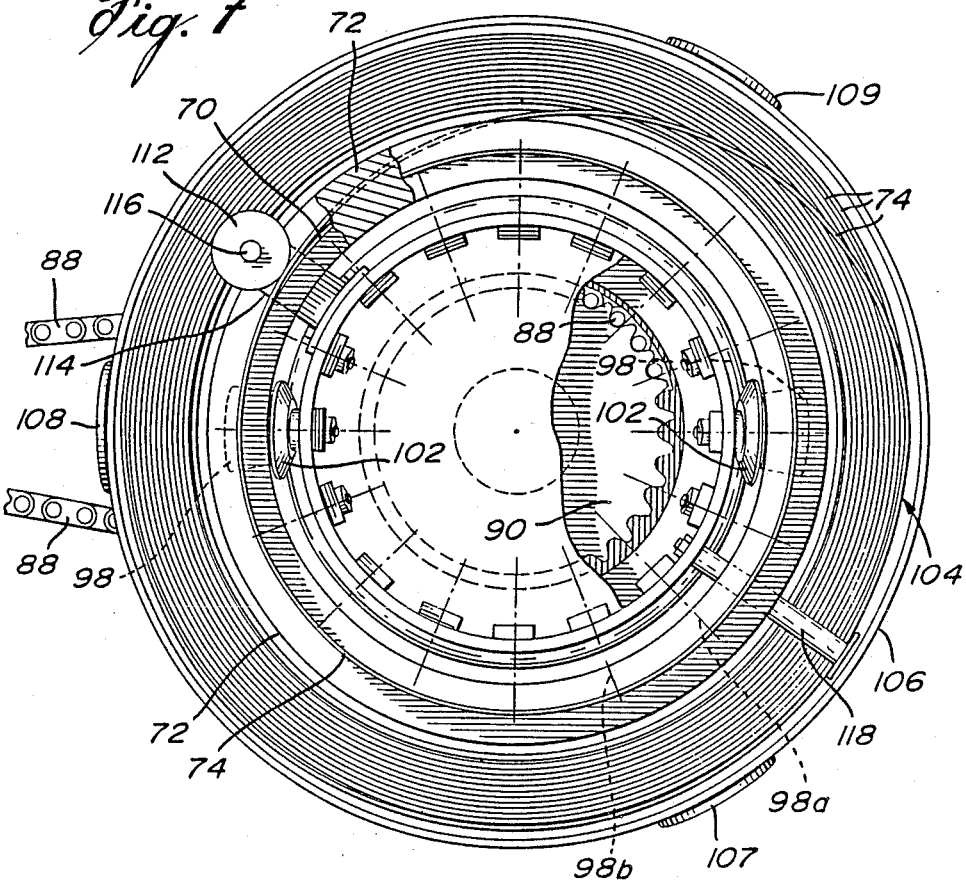
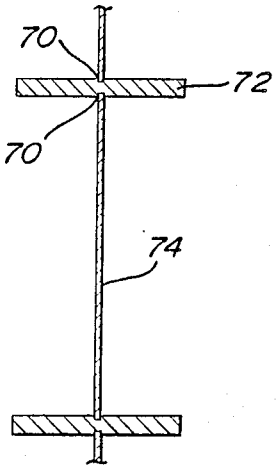
Fig. 8

PUSH ACTUATOR

CROSS-REFERENCE

This application is a Continuation-in-Part application based on co-pending U.S. patent application Ser. No. 07/151,650 filed Feb. 2, 1988 for a PUSH ACTUATOR in the name of Pierre GAGNON and Pierre LAFOREST, now abandoned.

FIELD OF THE INVENTION

The present invention relates to telescopic tubes, more particularly to be used as push actuators.

BACKGROUND OF THE INVENTION

Telescopic, single-acting hydraulic cylinders can be considered as push actuators. There is a practical limit in increasing the number of telescopic sections of such a hydraulic cylinder for the same to be confined within a minimum longitudinal extent when in retracted position. Therefore, such actuators, depending on the required stroke, occupy quite an important minimum length, when retracted. When used as a lifting device, for instance when several such cylinders are used to lift a floor section of a theatre scene, it is necessary to make important excavations in the ground to house such cylinders at their lower end portion.

It has been found that in certain locations, the water level in the ground does not permit such excavations. Therefore, there is a need for such particular theatre applications and also for some other applications where the available room is limited, to provide a push actuator which takes a minimum of length when retracted relative to its extension stroke.

OBJECTS OF THE INVENTION

The general object of the present invention is to provide a telescopic tube, which, for a given extension stroke, occupies minimum length when in retracted position.

Another object of the present invention is to provide a telescopic tube used as a push actuator which is of simple mechanical construction and which can exert a very high pushing force.

Another object of the present invention resides in the provision of a push actuator more particularly to be used as a lifting device or jack for lifting and lowering heavy loads.

SUMMARY OF THE INVENTION

The telescopic tube of the invention comprises a first annular band wound in helical form about a central axis with its turns transversely normal to said central axis and capable of taking a retracted stacked position, with its turns resting flat against one another, and an extended position with its turns spaced from one another in the direction of said central axis, a second band wound on itself, with its turns transversely parallel to said central axis, and capable of taking a retracted spiral position with its turns nested one within another and an extended position with its turns forming a helix around said central axis and generally equally, radially spaced therefrom to form a tube, said first and second bands, when in retracted position, in respective locations so as to clear each other, spacer means to successively space the turns of said first band, driving means to cause relative rotation of said first band of said spacer means about said central axis, and guide means to insert the turns of the second band between the spaced turns of the first band, with the edges of the turns of the second band bearing against the turns of the first band, the second band thus forming a spacer for the latter turns of the last band.

Said spacer means preferably include a support means forming a helix about said central axis, engageable between two successive turns of said first band and bearing against one of said turns. Preferably, the second band has an unstressed radius of curvature about equal to that of the extended tube. This causes easy insertion of the second band between the turns of the first band.

In one embodiment of the invention, said driving means include a power driven rotor rotatable about said central axis on a base, and surrounding the retracted first band. Said support means is fixed to the inside of said rotor and the retracted portion of said second band is carried by said rotor on the outside thereof. Said guide means is carried on the outside of said rotor. Locating means is carried by the turns of the first band and is engageable by the turns of the second band to locate the latter turns transversely of the turns of the first band.

In a second embodiment, both bands and the support means are arranged on the outside of the power-driven rotor.

BRIEF DESCRIPTION OF THE DRAWINGS

FIG. 7 is a plan section of the push actuator of FIG. 6; and

FIG. 8 is a cross-section of the assembly of the vertical band, with another embodiment of the horizontal band.

In the drawings, like reference numerals indicate like elements throughout.

DETAILED DESCRIPTION OF THE PREFERRED EMBODIMENT

Figure 1:
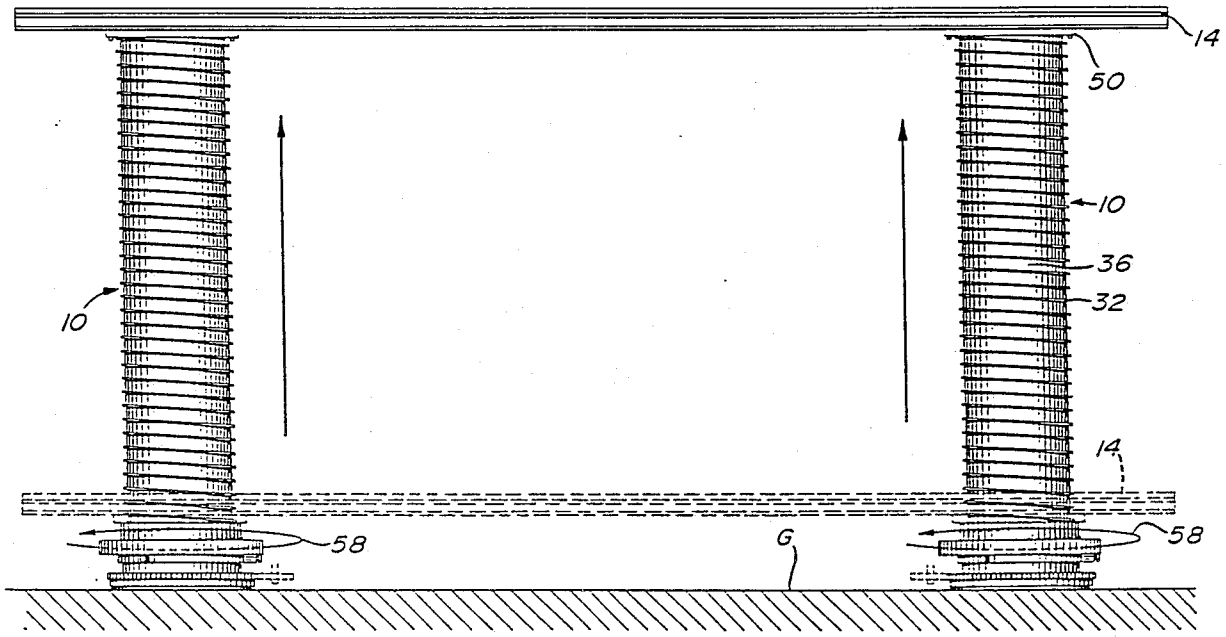
FIG. 1 is a front elevation of two push actuators used as jacks to raise a platform, such as a theatre scene section.

FIG. 1 shows two lifting jacks in accordance with the invention, generally indicated at 10, fixed to the ground 12 at their lower end and to a platform 14 at their upper end, the jacks 10 raising and lowering the platform 14. The platform 14 can be a section of a theatre scene, in which case there would be provided several jacks 10 to lift the same in synchronism.

Figure 2:
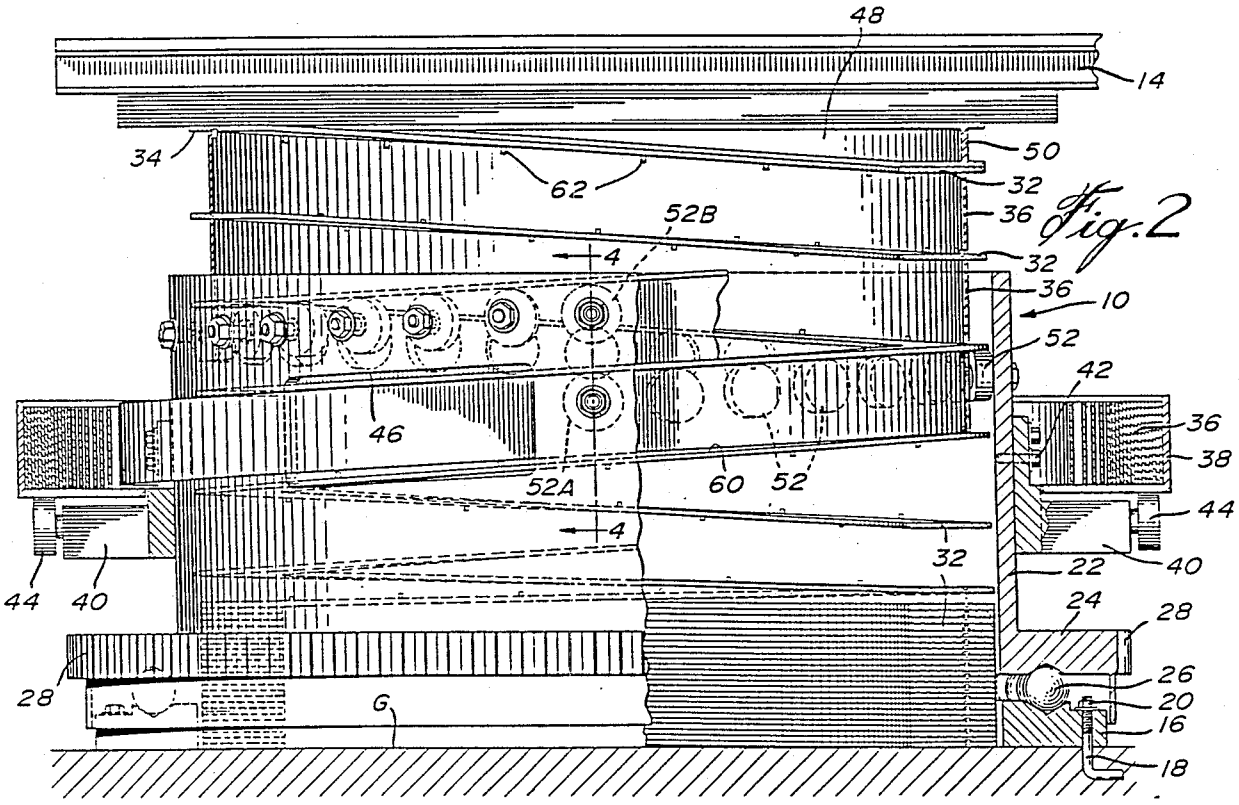
FIG. 2 is a front elevation, partially in vertical section, of a first embodiment of one push actuator shown in nearly- completely-retracted position, the section taken along line 2—2 of FIG. 3.

Referring to FIG. 2, each jack 10 of the first embodiment comprises an annular base 16 anchored to the ground 12, by means of L-shaped ground anchors 18 and nuts 20, or any other suitable anchoring means.

Figure 3:
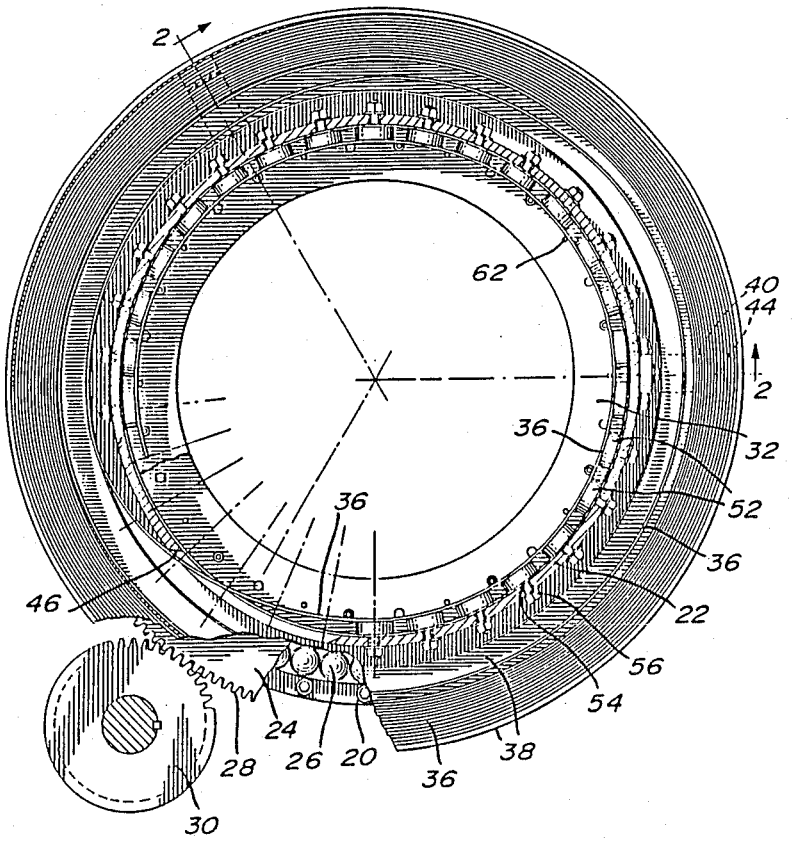
FIG. 3 is a plan section of the push actuator of FIG. 2.

A rotor 22, in the form of a cylindrical body with a lower radially- outwardly-extending flange 24, is rotatable on the base 16 by means of roller bearings 26 engaging annular V-shaped grooves made in the base 16 and lower flange 24. Thus, the rotor 22 is rotatable about the central axis of the base 16 and rotor 22. The peripheral edge of the lower flange 24 forms gear teeth 28 all around, in meshing engagement with a driving gear 30 (see FIG. 3) driven in rotation in both directions by a suitable motor, such as a reversible hydraulic motor, not shown.

A first continuous annular band 32, which will hereinafter be called the horizontal band for the particular application shown, is wound in an helix and is of such an external diameter as to fit within the rotor 22 and the base 16. The turns of this horizontal annular band can be successively lifted to provide a space therebetween. The lower end of the horizontal band 32 simply rests on the floor or ground G, while its upper leading end 34 is secured underneath the platform 14 by means, not shown.

A second band 36, hereinafter called the vertical band for the particular application described, is wound in spiral form, said band being continuous, and when in stacked condition, located within an annular storage box 38, disposed on the outside of rotor 22 and rotatably supported with respect to said rotor by means of three equally-angularly spaced L-shaped brackets 40 (see FIGS. 2 and 3) fixed to the outside of rotor 22 by bolts 42 and provided at their outer end with an idle roller 44 rotatably supporting the storage box 38. Brackets 40 could be fixed to floor G or to base 16.

As shown in FIG. 2, it is clear that the coil formed by vertical band 36 has a minimum diameter which is greater than the external diameter of the horizontal band 32, so as to clear the horizontal band when the latter is practically fully stacked, or when it is being extended. The radially outer end of the vertical band 36 need not be secured to the storage box 38. The radially inner leading end of the vertical band 36 extends through a rectangular opening 46 of rotor 22, inwardly of this rotor, and is tapered widthwise, as shown at 48 in FIG. 2, to be secured to the underside of the platform 40 by suitable means, such as a cross-sectionally I-shaped member 50. Leading end 48 fits between the radially inner flanges of member 50, the latter being longitudinally tapered as the leading end 48 and being directly secured underneath the platform 14. Therefore, the platform is maintained in level condition despite the fact that the vertical band 36 extends upwardly along a helix, as shown.

The rotor 22 is provided along its internal surface with a series of equally-spaced idle rollers 52, each mounted on a horizontal shaft 54, secured to the rotor by means of a nut 56. The idle rollers 52 are generally equally spaced for a full circle around the inside of the rotor 22 and arranged in a helix in accordance with the desired pitch of the assembly of the horizontal band 32 and vertical band 36. As shown in FIG. 2, the leading roller 52A is longitudinally aligned with the elongated opening 46, itself inclined in accordance with the above-noted pitch. The trailing roller 52B is vertically above and spaced from the leading roller 52A.

It will be understood that when the rotor 22 is rotated in accordance with arrows 58, shown in FIG. 1, in a direction to elevate platform 14, the idle rollers 52 will roll under the radially outer margin of the turns of the horizontal band 32 (see FIGS. 2 and 4), so as to space the same from the underlying adjacent turn. At the same time, the vertical band 36 enters opening 46 and is guided radially inwardly by the inner flat faces of the rollers 52 to be inserted between two adjacent turns of the horizontal band 32. As the horizontal band 32 is being elevated by rotation of the rotor, and consequently of the rollers 52, along an helix concentric with the central axis of the rotor, the vertical band is gradually inserted between the adjacent turns of the horizontal band, so as to gradually build up a kind of tube or column. As shown in FIG. 2, insertion of the vertical band is facilitated, since the weight of the horizontal band at the point of insertion causes the latter to form a gap 60.

Figure 5:
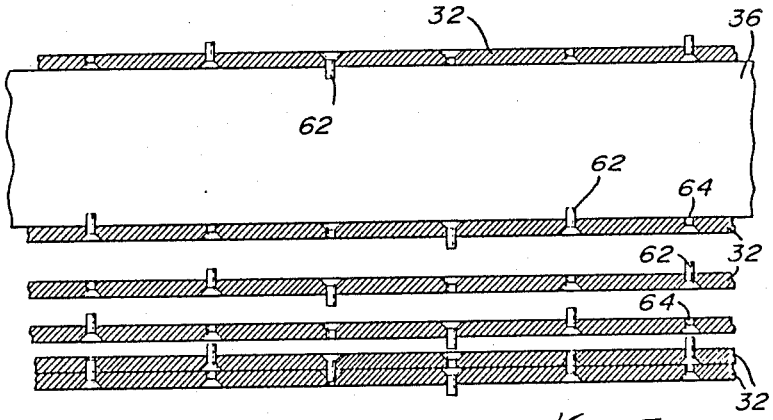
FIG. 5 is a developed longitudinal sectional elevation of the vertical band in inserted position between two turns of one embodiment of the horizontal band.

Means are provided to properly locate the vertical band between adjacent turns of the horizontal band. These means are more clearly shown in FIGS. 4 and 5. At the same time, these means allow flat stacking of the horizontal band in retracted position (see FIG. 2). These locating means include a plurality of studs 62 press-fitted within certain ones of a series of equally-spaced corresponding through-bores 64 made through the horizontal band 32, these through-bores 64 being at an equal distance from the outer peripheral edge of the horizontal band 32. As shown in FIG. 5, some of the studs 62 are upwardly directed, while the others are downwardly directed; this to locate both the top and bottom edges of the vertical band 36, this band abutting against said studs.

Some of the through-bores 64 are left without any studs, so as to receive the studs of the next adjacent turn of the horizontal band when the same is in retracted position, the protruding portion of the studs 62 not being any longer than the thickness of the horizontal band.

Figure 4:
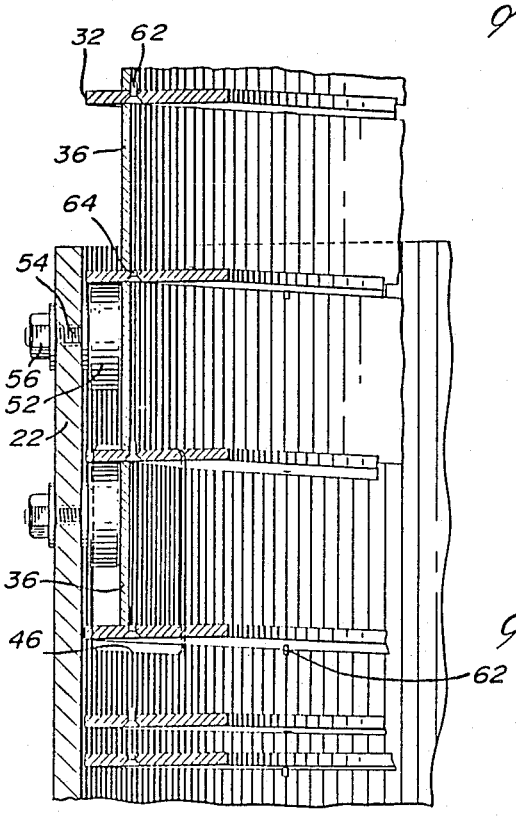
FIG. 4 is a partial longitudinal section taken along line 4—4 of FIG. 2.

In this manner, flat stacking of the horizontal band is obtained to store the same in a minimum of height. As shown in FIG. 4, the assembly of two adjacent turns of the horizontal band 32, with a turn of the vertical band 36 inserted therebetween, forms a substantially I-shaped cross-section. The resulting assembly is very strong and can support a very large load, and yet it is very stable transversely of the central axis. Depending on the length of the two bands 32 and 36, the push actuator of the invention can have a very long stroke compared to its length when the two bands are in retracted position.

Preferably, the vertical band is pre-rolled to possess when unstressed, a radius of curvature about equal to that of the assembled tube. This facilitates proper insertion of the vertical band between the turns of the horizontal band.

Magazine or box 38 is free to rotate about the tube axis to permit vertical band insertion and removal despite the resulting variation of the internal diameter of the coil formed by the vertical band in the box 38.

Figure 6:
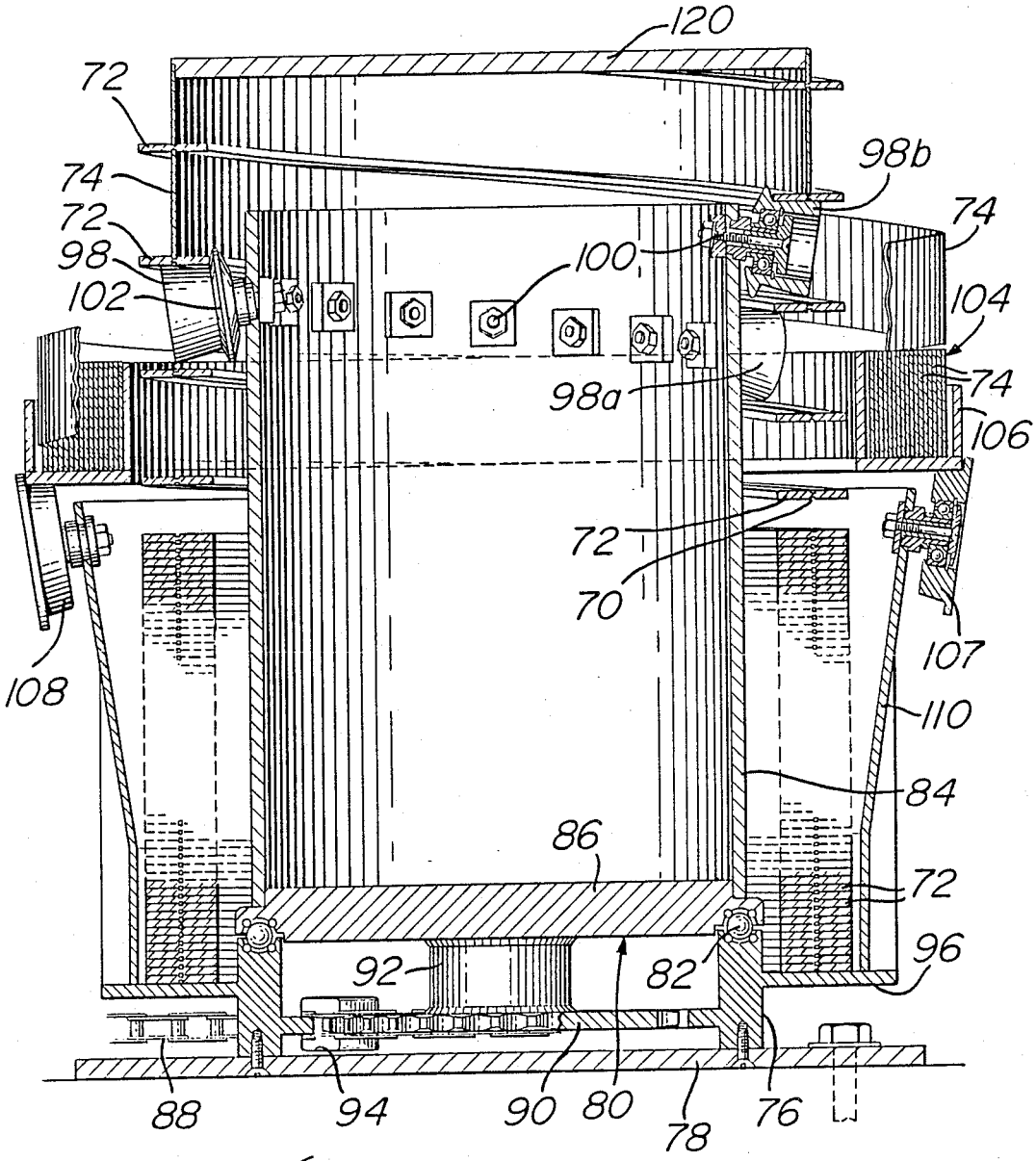
FIG. 6 is a vertical section of a second embodiment of a push actuator.

The second and preferred embodiment of the invention is illustrated in FIGS. 6 and 7. Also, FIG. 8 shows the preferred arrangement of the locating means for locating the vertical band transversely and centrally of the horizontal band. The locating means, shown in FIG. 8, are designed to replace the locating pins 62 inserted in holes 64 of the horizontal band 32, as illustrated in FIG. 5. The improved locating means simply consist of an upper and a lower continuous groove 70 made in the opposite main faces of the horizontal band 72. The grooves are disposed centrally of the width of the horizontal band 72 and are coaxial and co-extensive therewith. Thus, the grooves 70 serve to receive the longitudinal edges of the vertical band 74 to properly locate and retain the latter transversely of the horizontal band 72.

This modified arrangement can be used with the apparatus of FIGS. 1 to 4 as well as the apparatus shown in FIGS. 6 and 7. The telescopic tube shown in FIGS. 6 and 7 includes a base 76, of cylindrical shape, fixed to a ground plate 78. A rotor 80 is rotatably supported on the cylindrical base 76 through a ball bearing arrangement 82. The rotor 80 includes a cylindrical wall 84 press-fitted to an end disc 86.

The rotor 80 is power driven by a motor, not shown through a sprocket chain 88, trained on a sprocket gear 90, the shaft 92 of which is fixed to the underside of disc 86. Sprocket chain 88 issues through openings 94 made in cylindrical base 76. The several turns of the horizontal band 72 are stacked, when the band is in retracted position, on a flange 96 radially outwardly protruding from and secured to the base 76. Thus, the horizontal band 72 is coiled on the outside of the rotor 80.

A plurality of rollers 98 are mounted on the rotor 80 near the upper edge thereof on the outside of said rotor about radially-directed and downwardly-directed axes defined by retaining bolts 100. The rollers 98 are frustoconical in shape so as to support a turn of the horizontal band 72 in transversely-horizontal position normal to the central axis of the rotor 80. Each roller 98 has a tapered flange 102 to engage the inner longitudinal edge of the horizontal band 72 and center this band with respect to the rotor.

The rollers 98 are arranged in a helix through a full turn around the rotor, with the leading lower roller indicated at 98A and the trailing higher roller at 98 B with respect to the rotation of the rotor when the column or tube is being elevated.

The vertical band 74 is wound in a coil, indicated at 104, which is housed in an annular magazine or box 106 freely rotatably mounted on support wheels 107, 108 and 109 carried by upright arms 110 fixed at their lower end to the flange 96 outwardly of the horizontal band 72. The annular magazine 106 is of a minimum diameter greater than that of the horizontal band 72, so that the latter may freely extend through the magazine 106. The magazine is mounted for free rotation about the central axis of the tube or column. The vertical band 74 is pre-rolled or pre-formed to have a radius of curvature, when in unstressed condition, about equal to the diameter of the tube or column once the latter is assembled. The outermost turn of the coil 104 is led upwardly from the magazine and guided to move radially inwardly along a helix to be inserted between two adjacent turns of the horizontal band 72, the vertical band being guided by a guiding roller 112 (see FIG. 7), which is rotatably carried by a bracket 114 secured to the rotor 80. The roller 112 is rotatable about an axis 116, which is parallel to the central axis of the rotor 80, and the roller is applied against the outside face of the vertical band 74 to press the same for insertion between two adjacent turns of the horizontal band 72.

A rod 118 is also secured to the rotor 80 and extends radially outwardly therefrom to be applied against the top of the coil 104 at a position just before the outermost turn of the coil starts to move upwardly. This rod 118 serves to return the turns of the vertical band 74 in proper stacked position within the magazine 106 when the column is retracted. The guide roller 112 positively moves the vertical band 74 into engagement with the grooves 70 of the adjacent turns of the horizontal band 72.

The topmost end of the column may be defined by a pusher plate 120, which is fixed to the uppermost turn of the vertical band 74, the latter being tapered so that the plate 120 be normal to the central axis of the column or tube.

We claim:

1. A telescopic tube comprising a first annular band wound in helical form about a central axis with its turns transversely normal to said central axis and capable of taking a retracted stacked position with its turns resting flat against one another, and an extended position with its turns spaced from one another in the direction of said central axis, a second band wound on itself, with its turns transversely parallel to said central axis, and capable of taking a retracted, spiral position with its turns nested within one another and an extended position with its turns forming a helix around said central axis and generally equally radially spaced therefrom to form a tube, said first and second bands, when in retracted position, in respective locations so as to clear each other, spacer means to successively space the turns of said first band, driving means to cause relative rotation of said first band and of said spacer means about said central axis, and guide means to insert the turns of the second band between the spaced turns of the first band, with the edges of the turns of the second band bearing against the turns of the first band, the second band thus forming a spacer for the turns of the first band.

2. A telescopic tube as defined in claim 1, wherein said spacer means includes a support means forming a helix about said central axis, engageable between two successive turns of said first band and bearing against one of said last-named turns.

3. A telescopic tube as defined in claim 2, wherein driving means includes a power driven rotor rotatable about said central axis on a base, said support means and said guide means being mounted on said rotor, and further including an annular magazine containing the retracted portion of said second band, co-axial with said central axis and freely rotatable relative to said rotor and base.

4. A telescopic tube as defined in claim 3, and used as a lifting device, said central axis being generally vertical.

5. A telescopic tube as defined in claim 3, wherein said support means includes a series of rollers carried by said rotor, in the path of said first band and arranged along a helix extending through at least a full turn about said central axis, said rollers engageable with the turns of said first band to move the same apart.

6. A telescopic tube as defined in claim 1, further including locating means carried by the turns of the first band engageable with the turns of the second band, to locate the latter turns transversely of the turns of the first band.

7. A telescopic tube as defined in claim 6, wherein said locating means include pins protruding from a surface of the turns of the first band, said pins spacedly and generally equally protruding from the turns of the first band and engageable with an edge portion of the turns of the second band.

8. A telescopic tube as defined in claim 7, wherein a first series of pins project from one face of said first band, and a second series of pins project from the opposite face of said first band, so that the turns of the second band are engaged by said pins at their two longitudinal edges.

9. A telescopic tube as defined in claim 8, wherein said first band further includes a series of openings made therethrough, in register with said pins, to receive the same when the turns of the first band are in retracted position, resting flat one against another.

10. A telescopic tube as defined in claim 6, wherein said locating means include a groove made in at least one face of said first band coaxial and co-extensive therewith and adapted to receive a longitudinal edge of said second band.

11. A telescopic tube as defined in claim 10, wherein said locating means further include a second groove made in the opposite face of said first band coaxial and co-extensive with said first band, both grooves made centrally of said first band, said second groove adapted to receive the other longitudinal edge of said second band.

12. A telescopic tube as defined in claim 3, wherein said second band and its magazine are disposed radially outwardly of said first band.

13. A telescopic tube as defined in claim 12, wherein said rotor is located between said first band and said magazine with the second band therein.

14. A telescopic tube as defined in claim 13, wherein said support means include a series of rollers carried by said rotor internally thereof in the path of said first band and arranged along a helix through at least a full turn about said central axis, said rollers supporting a turn of said first band to move said turn away from an adjacent turn upon rotation of said rotor, and said guide means including an opening made in said rotor and through which said second band extends radially inwardly from said magazine, each roller having a radially inner face which forms a further part of said guide means by pushing said second band radially inwardly and maintaining said second band over a turn of said first band.

15. A telescopic tube as defined in claim 12, wherein said rotor is located inwardly of said first band and said support means includes a series of rollers carried by said rotor on the outside thereof in the path of said first band and arranged along a helix through at least a full turn about said central axis, said rollers supporting a turn of said first band to move said turn away from an adjacent turn upon rotation of said rotor, said guide means including a guide roller carried by said rotor on the outside thereof and engaging the radially outer face of said second band to cause its radially inward insertion between two spaced turns of said first band.

16. A telescopic tube as defined in claim 15, wherein said locating means includes grooves made in the two opposite main faces of said first band, said grooves being coaxial and coextensive with and made centrally of said first band, said grooves adapted to receive the longitudinal edges of said second band to hold the same centrally of said first band.

17. A telescopic tube as defined in claim 16, wherein said second band possesses, when unstressed, a radius of curvature about equal to that of the assembled tube.

* * * * *